US007072446B2

(12) United States Patent
Dobbs et al.

(10) Patent No.: US 7,072,446 B2
(45) Date of Patent: Jul. 4, 2006

(54) METHOD FOR MAKING X-RAY ANTI-SCATTER GRID

(75) Inventors: John M. Dobbs, Beverly, MA (US); Stephen M. Tobin, Watertown, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 10/747,573

(22) Filed: Dec. 29, 2003

(65) Prior Publication Data

US 2004/0228447 A1 Nov. 18, 2004

Related U.S. Application Data

(60) Provisional application No. 60/470,176, filed on May 13, 2003.

(51) Int. Cl.
*G21K 1/00* (2006.01)

(52) U.S. Cl. ..... 378/154

(58) Field of Classification Search ..... 378/154, 378/155; 250/505.1
See application file for complete search history.

(56) References Cited

U.S. PATENT DOCUMENTS

| | | | | |
|---|---|---|---|---|
| 2,143,799 | A * | 1/1939 | Schonander et al. | 378/154 |
| 4,340,818 | A * | 7/1982 | Barnes | 378/155 |
| 4,414,679 | A * | 11/1983 | Liebert et al. | 378/29 |
| 5,291,539 | A * | 3/1994 | Thumann et al. | 378/154 |
| 5,606,589 | A | 2/1997 | Pellegrino et al. | 378/154 |
| 5,970,118 | A * | 10/1999 | Sokolov | 378/155 |

FOREIGN PATENT DOCUMENTS

JP 05-038798 * 2/1993

* cited by examiner

*Primary Examiner*—Edward J. Glick
*Assistant Examiner*—Jurie Yun
(74) *Attorney, Agent, or Firm*—McDermott Will & Emery LLP

(57) ABSTRACT

A method for manufacturing an anti-scatter grid including arranging a plurality of elongated metal ribbons of radio-opaque material so that each ribbon is substantially straight and lies in a plane that passes through a focal point of the grid, and placing the elongated ribbons under tension. A first sheet of radioluscent material is secured to top edges of the ribbons, and a second sheet of radioluscent material is secured to bottom edges of the ribbons. The ribbons are arranged such that the first and second radioluscent sheets are substantially parallel. Then the tension is removed from the ribbons.

19 Claims, 4 Drawing Sheets

METHOD FOR MAKING X-RAY ANTI-SCATTER GRID

CROSS-REFERENCE TO RELATED APPLICATION

The present application claims priority from U.S. Provisional Patent Application Ser. No. 60/470,176 filed on May 13, 2003, which is assigned to the assignee of the present application and incorporated herein by reference.

FIELD OF THE INVENTION

The present invention generally relates to the field of medical radiography, and more particularly to a method of making an X-ray anti-scatter grid for use in patient diagnostic imaging procedures.

BACKGROUND OF THE INVENTION

Scattered X-ray radiation (sometimes referred to as secondary or off-axis radiation) is generally a serious problem in the field of radiography. Scattered X-ray radiation is a particularly serious problem in the field of X-ray patient diagnostic imaging procedures, such as mammographic procedures, where high contrast images are required to detect subtle changes in patient tissue.

Prior to the present invention, scattered X-ray radiation in patient diagnostic imaging procedures has been reduced through the use of a conventional linear focused scatter-reducing grid. The grid is interposed between the patient and an X-ray detector and tends to allow only the primary, information-containing radiation to pass to the detector while absorbing secondary or scattered radiation which contains no useful information about the patient tissue being irradiated to produce an X-ray image.

(05) Some conventional focused grids used in patient diagnostic imaging procedures generally comprise a plurality of X-ray opaque lead foil slats spaced apart and held in place by aluminum or fiber interspace filler. In focused grids, each of the lead foil slats, sometimes referred to as lamellae, are inclined relative to the plane of the film so as to be aimed edgewise towards the focal spot of the X-rays emanating from an X-ray source. Usually, during an imaging procedure, the standard practice is to move the focused grid in a lateral direction, perpendicular to the lamellae, so as to prevent the formation of a shadow pattern of grid lines on the X-ray image, which would appear if the grid were allowed to remain stationary. Such moving grids are known as Potter-Bucky grids.

One problem with conventional grids of the type described above is that the aluminum or fiber interspace filler material absorbs some of the primary, relatively low energy, information-containing X-ray radiation. Because some of the primary radiation is absorbed by the interspace material, the patient must be exposed to a higher dose of radiation than would be necessary if no grid were in place in order to compensate for the absorption losses imposed by the grid. It is an obvious goal in all radiography applications to expose the patient to the smallest amount of radiation needed to obtain an image having the highest image quality in terms of film blackening and contrast.

Another problem with such conventional focused grids of the parallel lamellae type described above is that they do not block scattered radiation components moving in a direction substantially parallel to the plane of the lamellae. Two-dimensional grids remove more scattered radiation for a given thickness of grid. However, the presence of walls at right angles mean that there is no direction which is perpendicular to all the walls, which makes moving the grids much more difficult.

U.S. Pat. No. 5,606,589 to Pellegrino, et al. discloses air cross grids for absorbing scattered secondary radiation and improving X-ray imaging in general radiography and in mammography. The grids are provided with a large plurality of open air passages extending through each grid panel. These passages are defined by two large pluralities of substantially parallel partition walls, respectively extending transverse to each other. Each grid panel is made by laminating a plurality of thin metal foil sheets photo-etched to create through openings defined by partition segments. The etched sheets are aligned and bonded to form the laminated grid panel, which is moved diagonally and a precise number of periods during the X-ray exposure to pass primary radiation through the air passages while absorbing scattered secondary radiation arriving along slanted paths. Proper movement of the grid is very critical, but is also difficult, resulting in significant reliability problems.

The method of Pellegrino, et al. produces sturdy cellular air cross grids having focused air passages offering radiation transmissivity about equal to the best linear grids presently available. However, it has been found that the etching method of Pellegrino, et al. does not produce grids with very fine and precise dimensions, as desired.

What is still desired are improved apparatuses and methods for making focused anti-scatter grids with more transmission and better uniformity. Preferably, such improved apparatuses and methods will be relatively easier, less time-consuming and less expensive than existing techniques for making focused anti-scatter grids.

SUMMARY OF THE INVENTION

Exemplary embodiments of the present invention provide a new and improved method for making anti-scatter grids. One exemplary embodiment of a method according to the present invention for manufacturing an anti-scatter grid includes arranging a plurality of elongated metal ribbons of radio-opaque material so that each ribbon is substantially straight and lies in a plane that passes through a focal point of the grid, and placing the elongated ribbons under tension. A first sheet of radiolucent material(also referred to herein as "radioluscent "material) is secured to top edges of the ribbons, and a second sheet of radioluscent material is secured to bottom edges of the ribbons. The ribbons are arranged such that the first and second radioluscent sheets are substantially parallel. The the tension is removed from the ribbons. The resulting grid is a structural sandwich that is very rigid even though it is made from flexible components.

The present invention also provides a new and improved anti-scatter grid including a plurality of elongated metal ribbons of radio-opaque material. Each ribbon is held substantially straight, under tension, and lies in a plane that passes through a focal point of the grid. The ribbons are arranged so that top edges of the ribbons are substantially parallel and so that bottom edges of the ribbons are substantially parallel. The grid also includes a first sheet of radioluscent material secured to the top edges of the ribbons, and a second sheet of radioluscent material secured to the bottom edges of the ribbons. The ribbons are arranged such that the first and second radioluscent sheets are essentially parallel.

Additional aspects and advantages of the present invention will become readily apparent to those skilled in this art from the following detailed description, wherein exemplary embodiments of the present invention are shown and described, simply by way of illustration of the best modes contemplated for carrying out the present invention. As will be realized, the present invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF EXEMPLARY EMBODIMENT

Figure 1:
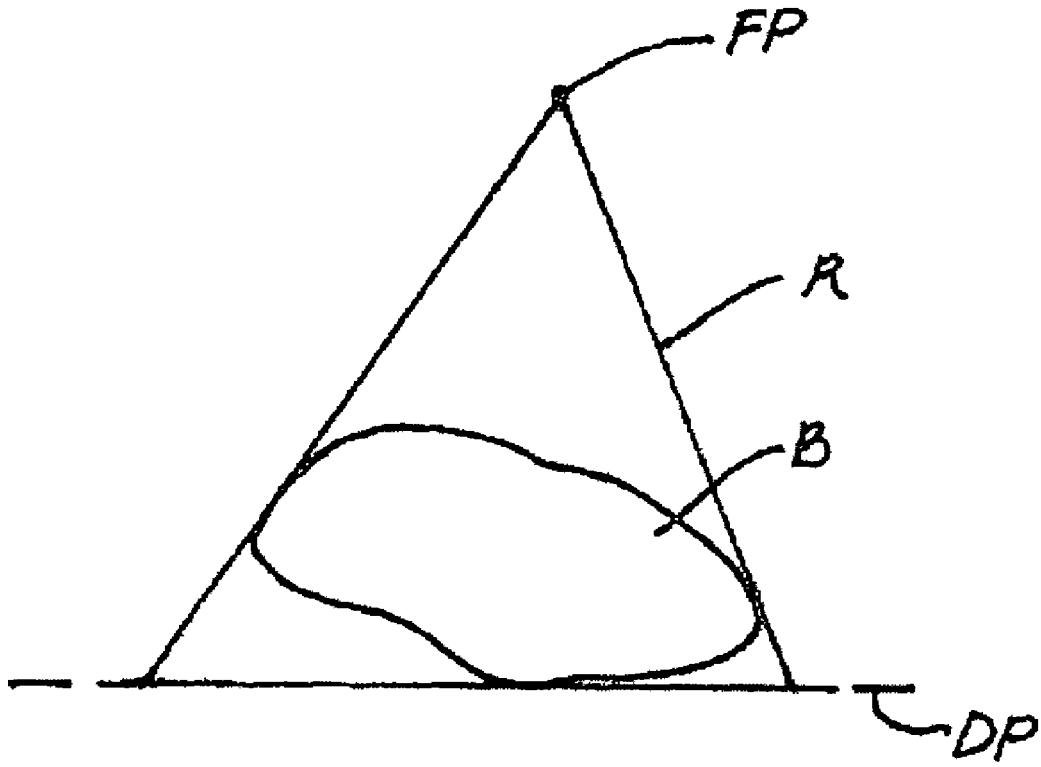
FIG. 1 is a schematic illustration showing X-rays passing from a source at a focal point, through an object such a patient's body, and to a detector plane.
Figure 2:
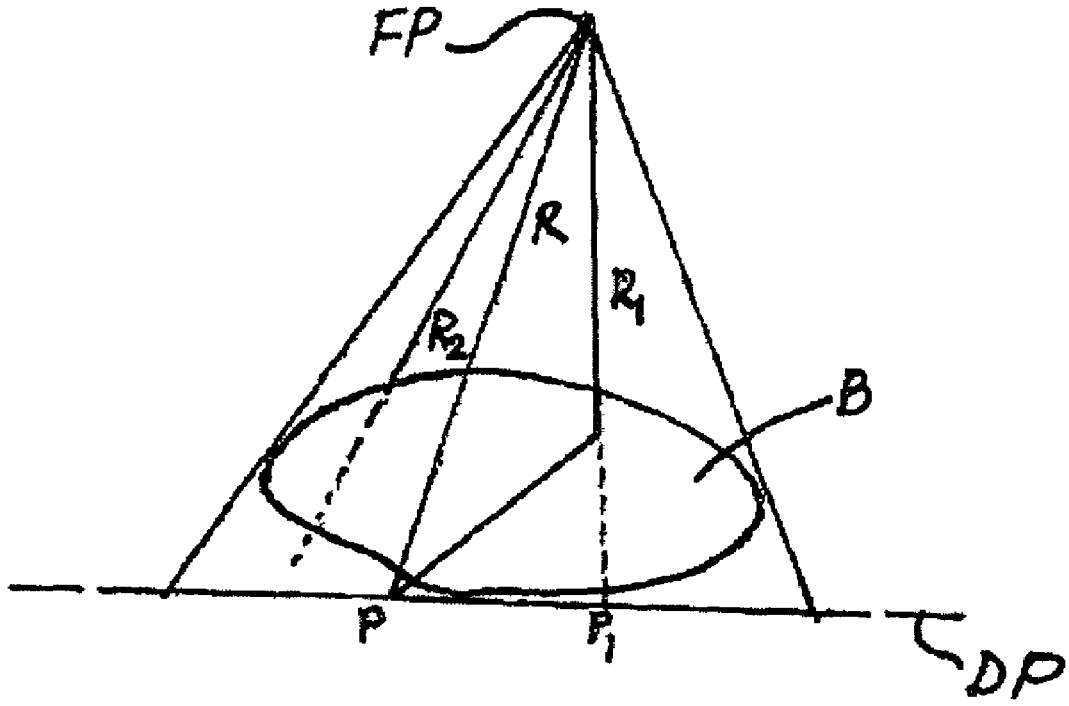
FIG. 2 is a schematic illustration showing X-rays passing from a source at a focal point, through an object such a patient's body, and to a detector plan, and wherein some of the X-rays are shown being deflected or scattered before reaching the detector plane.

X-ray imaging uses the fact that x-rays "R" are extremely penetrating but are absorbed by the material "B" (such as a patient's body through which they pass. An x-ray image is the two-dimensional map of the x-ray absorption of the material "B" lying between an x-ray source located at a focal point "FP" and an X-ray detector located at a detector plane "DP". FIG. 1 shows a typical medical x-ray imaging situation. The quality of the image depends on the fact that a significant fraction of the x-rays R are absorbed rather than scattered. Referring to FIG. 2, Ray R is emitted from the source located at the focal point FP and detected at point P by the X-ray detector located at the detector plane DP. Ray $R_1$ scatters and is also detected at the point P. Ray $R_2$ is totally absorbed and, therefore, not detected. In the making of an image, occurrences such as these happen many millions of times.

The fact that $R_1$ scattered and was detected at P causes density along the ray $R_1$ to be appropriately assigned to the point $P_1$. However, the point P receives radiation from the ray $R_1$ and, therefore, the density along the ray R is measured to be lower than it actually is. Since scattering occurs in all directions, there is very little spatial information contained in the scattered radiation. The scattered radiation tends to blur the image and lower the measured absorption of localized regions of high absorption.

Figure 3:
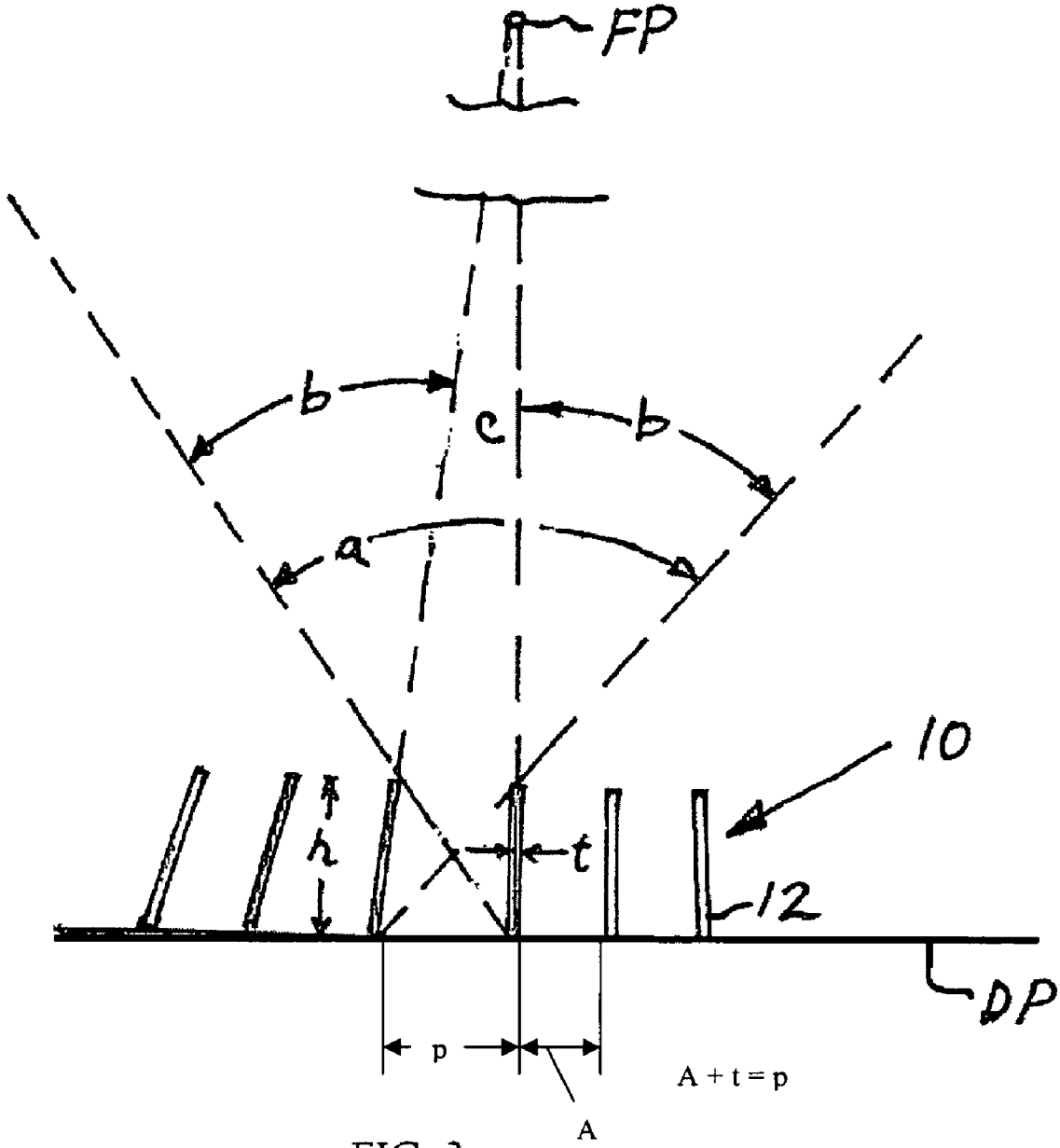
FIG. 3 is a schematic illustration showing an exemplary embodiment of an anti-scatter grid positioned between a source at a focal point and a detector plane, and illustrating how the anti-scatter grid prevents deflected or scattered X-rays from reaching the detector plane.

This problem can be ameliorated by placing a grid 10 of plates 12 in front of the X-ray detector DP which prevents the scattered radiation from reaching the detector, as shown in FIG. 3. The grid 10 is formed of a high atomic number material, such as tungsten or tantulum. Each of these plates 12 should be positioned so that the focal spot FP lies in the plane of the plate 12. As illustrated in FIG. 3, it is clear that scattered radiation emanating from outside region (a) will not be detected; a fraction of the radiation emanating from the two regions labeled (b) and directed towards the region (a) will be detected; and all the radiation emanating from (c) and directed towards the region (a) will be detected.

Furthermore, it is clear that this grid 10 will remove some of the unscattered radiation because the plates 12 have a finite thickness "t" and that the geometric efficiency of the grid 10 is (p−t)/p or A/p where "p" is the period of the grid and "A" is the area between the plates 12. It is also clear that the effectiveness of the grid 10 in removing scattered radiation increases as the ratio h/p increases, where "h" is the height of the grid 10 in the direction of the x-ray beam.

Figure 4:
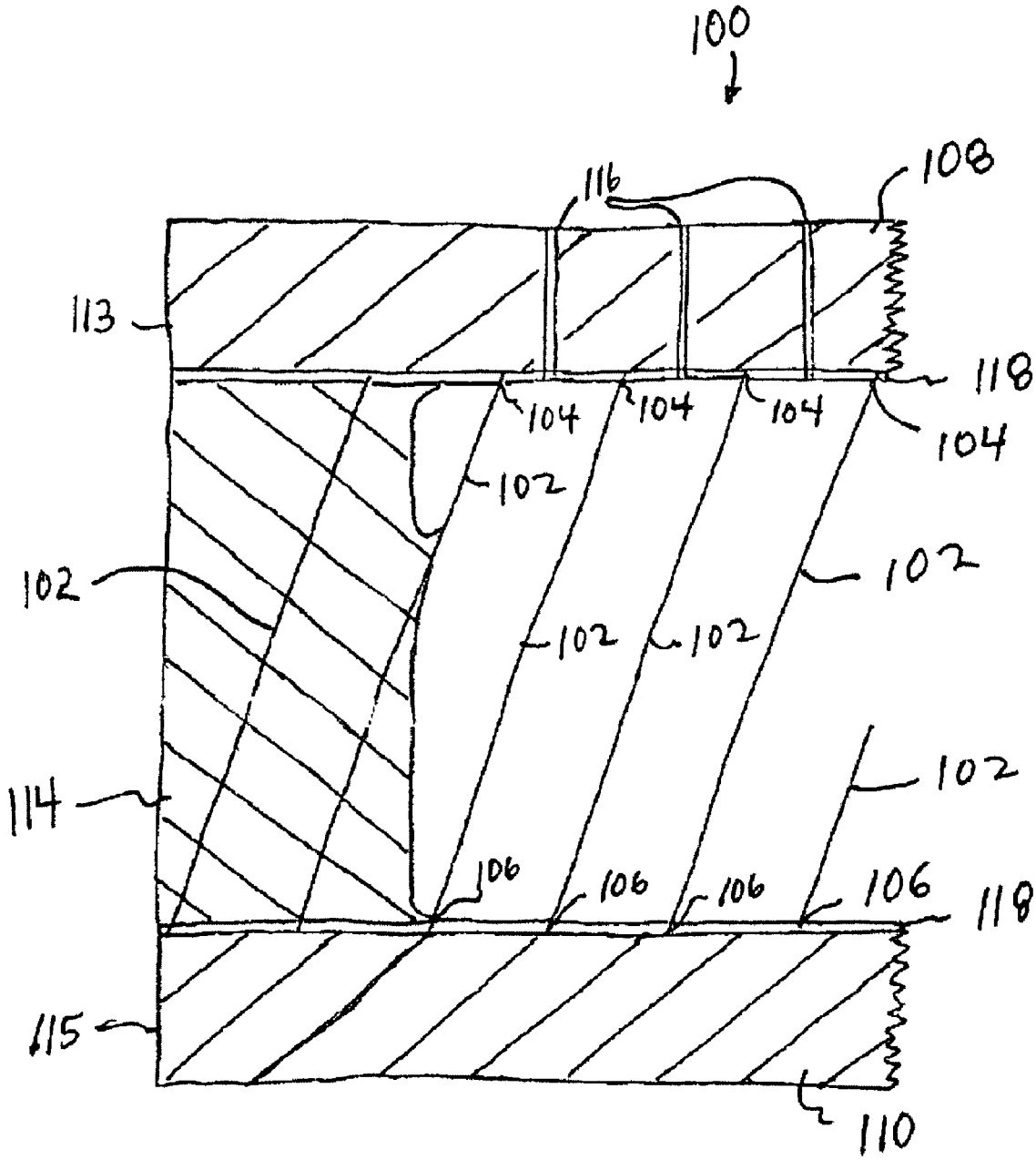
FIG. 4 is an end sectional view of an exemplary embodiment of a new and improved anti-scatter grid constructed in accordance with the present invention.
Figure 5:
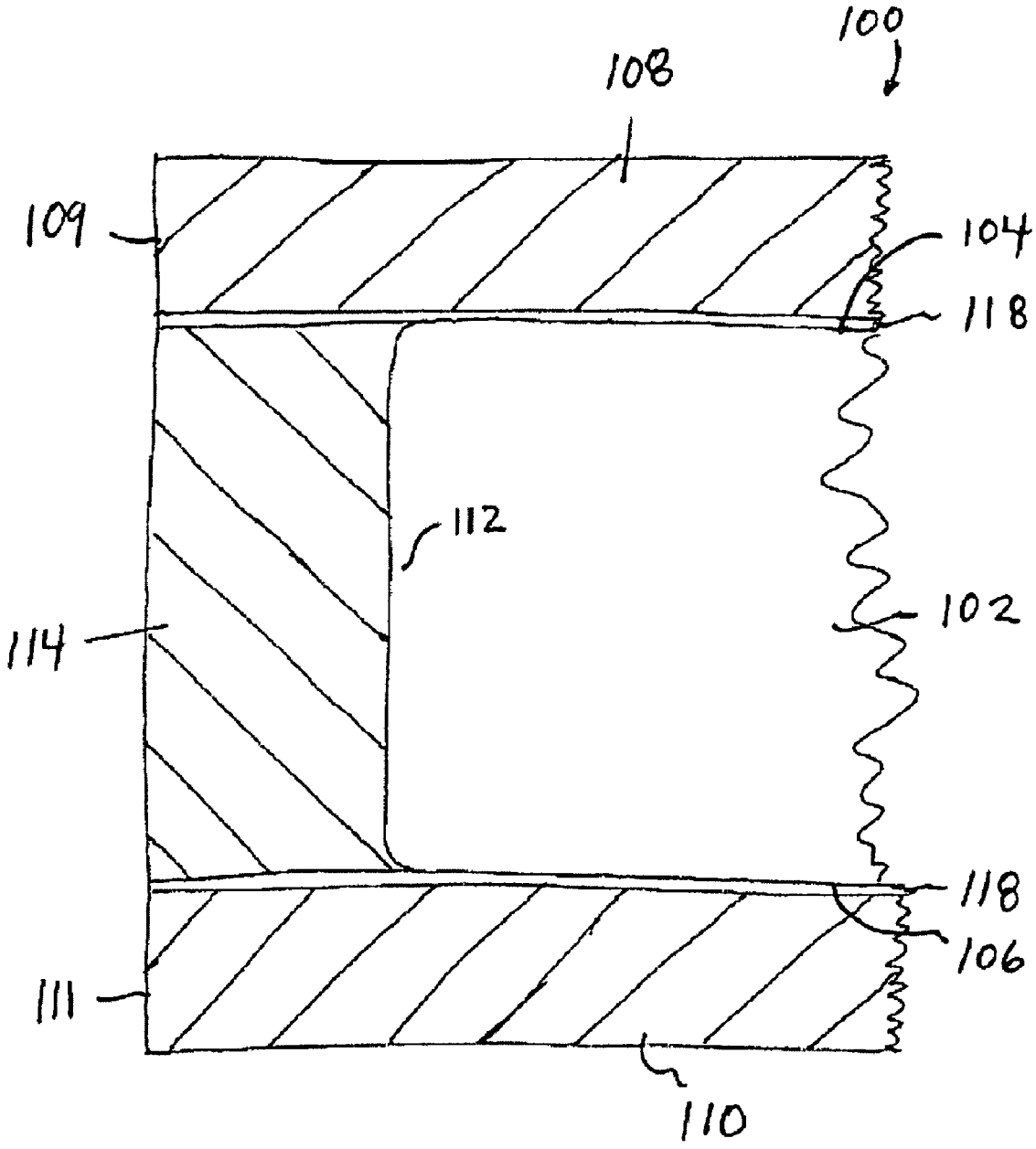
FIG. 5 is a side sectional view of the anti-scatter grid of FIG. 4.

Referring now to FIGS. 4 and 5, an exemplary embodiment of a new and improved anti-scatter grid 100 constructed in accordance with the present invention is shown. The grid 100 is a sturdy and highly useful implement in the X-ray patient diagnostic imaging field, and provides the desired absorption of scattered secondary radiation.

The anti-scatter grid 100 includes a plurality of elongated metal ribbons 102 of radio-opaque material. Each ribbon is held substantially straight, under tension, and lies in a plane that passes through a focal point of the grid. The ribbons 102 are arranged so that top edges 104 of the ribbons 102 are substantially parallel and so that bottom edges 106 of the ribbons 102 are substantially parallel. The grid also includes a first sheet 108 of radioluscent material secured to the top edges 104 of the ribbons 102, and a second sheet 110 of radioluscent material secured to the bottom edges 106 of the ribbons 102. The ribbons 102 are arranged such that the first and second radioluscent sheets 108, 110 are parallel.

The grid 100 is a structural sandwich that is very rigid even though it is made from flexible components. In one exemplary embodiment, the ribbons 102 are each placed under tension. Ends 112 of the ribbons 102 do not extend beyond ends 109, 111 of the first and second radioluscent sheets 108, 110, and the ends 112 of the ribbons 102 and ends 109, 111 of the first and second radioluscent sheets 108, 110, as well as sides 113, 115 of the sheets 108, 110 can be potted with a thin beam 114 of epoxy. If necessary, at least one of the first and second radioluscent sheets 108, 110 can include holes 116 to allow pressure equalization within spaces between the ribbons 102.

In the exemplary embodiment shown in FIGS. 4 and 5, the first and second radioluscent sheets 108, 110 are secured to the ribbons 102 with layers of adhesive 118 while the ribbons are under tension. In particular, the radioluscent sheets 108, 110 are provided as previously cured carbon/epoxy sheets 108, 110 coated with the thin uniform layer of adhesive for securing the sheets 108, 110 to the ribbons 102. Alternatively, the first and second radioluscent sheets 108, 110 can be provided as semi-hardened sheets 108, 110 of epoxy impregnated carbon fiber cloth which is secured to the ribbons 102 by pressing the sheets 108, 110 against the ribbons 102 and allowing the sheets 108, 110 to cure. In any event, the first and second radioluscent sheets 108, 110 each have a thickness of about between 0.25 mm and 0.5 mm in accordance with one possible embodiment of the invention. When the sheets 108 and 110 are bonded to the ribbons 102, the ribbons 102 are cut down to the ends 109, 111 of the sheets 108, 110. The edges of this structure are then potted in four steps (one for each side) which stabilizes and strengthens the assembly.

The metal ribbons 102 are can be made of tungsten or tantalum, for example. In one exemplary embodiment, the grid has dimensions of 24 cm×30 cm or 18 cm×24 cm, with the ribbons 102 extending perpendicular to the long dimension. The ribbons 102 are spaced about 0.3 mm apart, and the plurality of ribbons 102 comprises about one-thousand (1,000) ribbons 102. In one exemplary embodiment, the ribbons 102 are each about twenty-four (24) cm long, about two (2) mm wide, and about fifteen (15) to eighteen (18) microns thick.

The grid 100 shown in FIGS. 4 and 5 is a one-dimensional grid 100, but could also be provided in the form of a two-dimensional grid. Although not shown, a two-dimensional grid can be provided. In a two-dimensional grid, the plurality of elongated metal ribbons comprise a first set and the anti-scatter grid further comprises a second set of a plurality of elongated metal ribbons of radio-opaque material. Each ribbon of the second set is held substantially straight, under tension, and lies in a plane that passes through a focal point of the grid, and the ribbons of the second set are arranged so that top edges of the ribbons of the second set are substantially parallel and so that bottom edges of the ribbons of the second set are substantially parallel. The bottom edges of the ribbons of the second set are secured to the second sheet of radioluscent material, and a third sheet of radioluscent material is secured to the top edges of the ribbons of the second set. The second set of ribbons are also arranged such that the second and the third radioluscent sheets are substantially parallel. In one exemplary embodiment, the first and the second set of ribbons are arranged so that the first set of ribbons extends substantially perpendicular to the second set of ribbons.

The present invention also provides methods for making the focused anti-scatter grid 100 of FIGS. 4 and 5. One exemplary embodiment of a method 200 according to the present invention for manufacturing the anti-scatter grid 100 includes arranging a plurality of the elongated metal ribbons 102 of radio-opaque material so that each ribbon is substantially straight and lies in a plane that passes through a focal point of the grid. Then, the elongated ribbons 102 are placed under tension, and the first sheet 108 of radioluscent material is secured to the top edges 104 of the ribbons 102, and the second sheet 110 of radioluscent material is secured to bottom edges 106 of the ribbons 102. The ribbons 102 preferably have been arranged such that the first and second radioluscent sheets 108, 110 are parallel. After the sheets 108, 110 have been secured to the ribbons 102, the tension is removed from the ribbons 102. The method 200 provides a grid 100 that is a structural sandwich that is very rigid even though the grid 100 is made from flexible components, such as the thin ribbons 102 and the thin sheets 108, 110.

The new and improved linear grid 100 of the present invention has been found to provide a much better transmission than existing two-dimensional grids. The ribbons 102 are very thin (e.g., 0.012 mm) and the cover sheets 108, 110 are thin and very low atomic number (e.g., 0.25 mm thick and made of carbon fiber and epoxy). The new and improved linear grid 100 of the present invention is also an improvement because the grid simply has air between the ribbons 102. Furthermore, the one-dimensional grid 100 is easier to move than a two-dimensional grid since the extra set of grid walls in the two-dimensional grid provides artifacts.

It will thus be seen that the objects set forth above, and those made apparent from the preceding description, are efficiently attained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for manufacturing an anti-scatter grid comprising:

arranging a plurality of elongated metal ribbons of radio-opaque material so that each ribbon is substantially straight and lies in a plane that passes through a focal point of the grid;

placing the elongated ribbons under tension;

securing a first sheet of radioluscent material to top edges of the ribbons;

securing a second sheet of radioluscent material to bottom edges of the ribbons, wherein the ribbons are arranged such that the first and second radioluscent sheets are parallel; and removing the tension from the ribbons.

2. A method according to claim 1, further comprising trimming ends of the ribbons so that the ends of the ribbons do not extend beyond ends of the first and second radioluscent sheets.

3. A method according to claim 1, further comprising potting ends of the ribbons and ends of the first and second radioluscent sheets.

4. A method according to claim 1, wherein the metal ribbons are made of tungsten.

5. A method according to claim 1, wherein the metal ribbons are made of tantalum.

6. A method according to claim 1, wherein the plurality of ribbons comprises about 1,000 ribbons.

7. A method according to claim 1, wherein the ribbons are each about 24 cm long.

8. A method according to claim 1, wherein the ribbons are each about 1.5 mm to about 3 mm wide.

9. A method according to claim 1, wherein the ribbons are each about 15 to 18 microns thick.

10. A method according to claim 1, wherein the ribbons are spaced about 0.3 mm apart.

11. A method according to claim 1, wherein the ribbons are each placed under tension equal to about one once.

12. A method according to claim 1, wherein the first and second radioluscent sheets are secured to the ribbons with layers of adhesive.

13. A method according to claim 1, wherein the first and second radioluscent sheets are secured to the ribbons by pressing the uncured sheets against the ribbons and allowing the sheets to cure.

14. A method according to claim 1, wherein the first and second radioluscent sheets comprise carbon fiber.

15. A method according to claim 1, wherein the first and second radioluscent sheets comprise epoxy impregnated carbon fiber cloth.

16. A method according to claim 1, wherein the first and second radioluscent sheets each have a thickness of about between 0.25 mm and 0.5 mm.

17. A method according to claim 1, further comprising providing holes in at least one of the first and second radioluscent sheets to allow pressure equalization within spaces between the ribbons.

18. A method according to claim 1, wherein the plurality of elongated metal ribbons comprises a first set and the method further comprises:

arranging a second set of a plurality of elongated metal ribbons of radio-opaque material so that each ribbon is substantially straight and lies in a plane that passes through a focal point of the grid;

placing the second set of ribbons under tension;

securing bottom edges of the second set of ribbons to the second sheet of radioluscent material;

securing a third sheet of radioluscent material to top edges of the second set of ribbons, wherein the second set of ribbons are arranged such that the second and the third radioluscent sheets are parallel; and removing the tension from the second set of ribbons.

19. A method according to claim 18, wherein the first and the second set of ribbons are arranged so that the first set of ribbons extends perpendicular to the second set of ribbons.

* * * * *

UNITED STATES PATENT AND TRADEMARK OFFICE

CERTIFICATE OF CORRECTION

PATENT NO. : 7,072,446 B2
APPLICATION NO. : 10/747573
DATED : July 4, 2006
INVENTOR(S) : John M. Dobbs et al.

It is certified that error appears in the above-identified patent and that said Letters Patent is hereby corrected as shown below:

Column 6, line 22, delete “radioluscent” and replace with --radiolucent--.
Column 6, line 24, delete “radioluscent” and replace with --radiolucent--.
Column 6, line 26, delete “radioluscent” and replace with --radiolucent--.
Column 6, line 31, delete “radioluscent” and replace with --radiolucent--.
Column 6, line 35, delete “radioluscent” and replace with --radiolucent--.
Column 6, line 52, delete “radioluscent” and replace with --radiolucent--.
Column 6, line 54, delete “radioluscent” and replace with --radiolucent--.
Column 6, line 57, delete “radioluscent” and replace with --radiolucent--.
Column 6, line 61, delete “radioluscent” and replace with --radiolucent--.
Column 6, line 63, delete “radioluscent” and replace with --radiolucent--.
Column 6, line 66, delete “radioluscent” and replace with --radiolucent--.
Column 7, line 3, delete “radioluscent” and replace with --radiolucent--.
Column 8, line 2, delete “radioluscent” and replace with --radiolucent--.
Column 8, line 3, delete “radioluscent” and replace with --radiolucent--.
Column 8, line 6, delete “radioluscent” and replace with --radiolucent--.

Signed and Sealed this

Twenty-ninth Day of April, 2008

JON W. DUDAS
*Director of the United States Patent and Trademark Office*